US011355084B2

(12) United States Patent
Matsumoto et al.

(10) Patent No.: US 11,355,084 B2
(45) Date of Patent: Jun. 7, 2022

(54) DISPLAY DEVICE AND METHOD OF PREVENTING AFTERIMAGE THEREOF

(71) Applicant: SAMSUNG DISPLAY CO., LTD., Yongin-si (KR)

(72) Inventors: Kazuhiro Matsumoto, Yokohama (JP); Masahiko Takiguchi, Yokohama (JP)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/101,331

(22) Filed: Nov. 23, 2020

(65) Prior Publication Data

US 2021/0225327 A1 Jul. 22, 2021

(30) Foreign Application Priority Data

Jan. 21, 2020 (KR) ..... 10-2020-0007940

(51) Int. Cl.
*G09G 5/10* (2006.01)
*G09G 3/3225* (2016.01)

(52) U.S. Cl.
CPC ..... *G09G 5/10* (2013.01); *G09G 3/3225* (2013.01); *G09G 2320/0257* (2013.01); *G09G 2320/0646* (2013.01)

(58) Field of Classification Search
CPC ..... G09G 5/10; G09G 3/3225; G09G 2320/0257; G09G 2320/0646
See application file for complete search history.

(56) References Cited

U.S. PATENT DOCUMENTS

2007/0146237 A1* 6/2007 Lee ..... G09G 5/003 345/42
2015/0154939 A1* 6/2015 Zhan ..... G06T 7/00 345/589
2018/0247549 A1* 8/2018 Martin ..... G06N 3/084
2019/0156746 A1 5/2019 Kim et al.
2019/0278323 A1* 9/2019 Aurongzeb ..... H01L 27/3269
2020/0020303 A1* 1/2020 Kim ..... G06K 9/3266
2020/0202772 A1* 6/2020 Ji ..... G09G 3/3208
2020/0211503 A1* 7/2020 Lee ..... G09G 5/10
2020/0234447 A1* 7/2020 Karmatha ..... G06N 3/082
2020/0365118 A1* 11/2020 Zhang ..... G09G 5/391
2021/0225326 A1* 7/2021 Matsumoto ..... G09G 3/3233
2021/0279871 A1* 9/2021 Johnson ..... G16H 30/20

FOREIGN PATENT DOCUMENTS

KR 10-2016-0019341 2/2016
KR 10-2018-0013189 2/2018
KR 10-2021-0094692 7/2021

* cited by examiner

*Primary Examiner* — Antonio Xavier
(74) *Attorney, Agent, or Firm* — F. Chau & Associates, LLC

(57) ABSTRACT

The present disclosure provides a display device. The display device includes a controller and a display panel displaying an image. The controller includes a detector, a compensator, and a converter. The detector separates image data into first image data corresponding to a first image recognized as a non-afterimage component and second image data corresponding to a second image recognized as an afterimage component using a pre-trained deep neural network. The compensator outputs a compensation signal to control a luminance value of the second image data. The converter converts the first image data to first converted image data and converting the second image data to second converted image data based on the compensation signal.

16 Claims, 7 Drawing Sheets

DISPLAY DEVICE AND METHOD OF PREVENTING AFTERIMAGE THEREOF

CROSS-REFERENCE TO RELATED APPLICATION

This U.S. non-provisional patent application claims priority under 35 U.S.C. § 119 of Korean Patent Application No. 10-2020-0007940, filed on Jan. 21, 2020, the contents of which are hereby incorporated by reference in their entirety.

BACKGROUND

1. Field of Disclosure

The present disclosure relates to a method of preventing an afterimage due to deterioration and a display device with improved display characteristics.

2. Description of the Related Art

Display devices show images to a user using light sources such as light-emitting diodes. Display devices are present in televisions, smartphones, and computers. An organic light-emitting display (OLED) device is a type of display device. OLED devices have fast response, low power consumption, superior light emission efficiency, good brightness, and a wide viewing angle.

Transistors or light-emitting diodes of a pixel may deteriorate when an OLED device is used for a long period of time. Furthermore, a difference in degree of deterioration between a certain display area and another display area adjacent to the certain display area occurs when the same image is continuously displayed in the certain display area.

The difference in degree of deterioration leads to the deterioration of display quality such as afterimages, or burn-in, on the display device. Therefore, there is a need in the art to increase the reliability of OLED devices, and to reduce the likelihood of afterimages.

SUMMARY

The present disclosure provides a display device with improved display characteristics, and a method of preventing an afterimage due to deterioration.

Embodiments of the inventive concept provide a display device including a controller receiving an image data and converting the image data to output first converted image data and second converted image data and a display panel displaying an image corresponding to the first converted image data and the second converted image data. The controller includes a detector separating the image data into first image data corresponding to a first image recognized as a non-afterimage component and second image data corresponding to a second image recognized as an afterimage component using a pre-trained deep neural network, a compensator outputting a compensation signal to control a luminance value of the second image data, and a converter converting the first image data to the first converted image data and converting the second image data to the second converted image data based on the compensation signal.

The deep neural network performs a semantic segmentation on the image data (e.g., frame by frame) to separate the image data into the first image data and the second image data. The deep neural network includes a fully convolutional neural network. The display device further includes a memory in which the deep neural network is stored, and the memory receives data to update the deep neural network.

The compensation signal includes at least one of a first compensation signal that decreases a luminance value of high luminance data of the second image data, a second compensation signal that increases a luminance value of low luminance data of the second image data, and a third compensation signal that maintains a luminance value of the second image data.

The afterimage component is classified into a first afterimage component and a second afterimage component with a transmittance higher than a transmittance of the first afterimage component, and the compensator includes a first determiner that determines whether the second image is recognized as the first afterimage component or the second afterimage component.

The display device further includes an average luminance calculator that calculates a first average luminance value using a spatial average luminance value of the second image data when the second image is recognized as the first afterimage component and calculates a second average luminance value using the spatial average luminance value and a temporal average luminance value of the second image data when the second image is recognized as the second afterimage component.

When the second image is recognized as the first afterimage component, the first compensation signal decreases the luminance value of the second image to have a luminance value of the second image higher than the first average luminance value and the second compensation signal increases the luminance value of the second image to have a luminance value of the second image lower than the first average luminance value, and when the second image is recognized as the second afterimage component, the first compensation signal decreases the luminance value of the second image to have a luminance value of the second image higher than the second average luminance value.

Each of the first afterimage component and the second afterimage component is classified into a first group in which a display cumulative time ratio of the second image to a display time of the image data is equal to or greater than about 50% and equal to or smaller than about 100%, a second group in which the display cumulative time ratio exceeds about 20% and is smaller than about 50%, and a third group in which the display cumulative time ratio is equal to or greater than about 10% and is equal to or smaller than about 20%, and the compensator further includes a second determiner that determines whether the second image is recognized as the first, second, or third group afterimage component.

The compensation signal includes the first compensation signal and the second compensation signal when the first afterimage component is the first group. The compensation signal includes the first compensation signal when the first afterimage component is the second group. The compensation signal includes the third compensation signal when the first afterimage component is the third group. The compensation signal includes the first compensation signal when the second afterimage component is the first group. The compensation signal includes the third compensation signal when the second afterimage component is the second group or the third group.

Embodiments of the inventive concept provide a method of preventing an afterimage including separating image data into first image data corresponding to a first image recognized as a non-afterimage component and second image data corresponding to a second image recognized as an afterimage component using a pre-trained deep neural network, outputting a compensation signal to control a luminance value of the second image data, converting the first image data to first converted image data and converting the second image data to second converted image data based on the compensation signal.

The separating of the first image data from the second image data may include performing a semantic segmentation on the image data on a per frame basis. The afterimage component is classified into a first afterimage component and a second afterimage component with a transmittance higher than a transmittance of the first afterimage component, and the outputting of the compensation signal includes determining whether the second image is recognized as the first afterimage component or the second afterimage component.

Each of the first afterimage component and the second afterimage component is classified into a first group in which a display cumulative time ratio of the second image to a display time of the image data is equal to or greater than about 50% and equal to or smaller than about 100%, a second group in which the display cumulative time ratio exceeds about 20% and is smaller than about 50%, and a third group in which the display cumulative time ratio is equal to or greater than about 10% and is equal to or smaller than about 20%, and the outputting of the compensation signal further includes determining whether the second image is recognized as the first, second, or third group.

The compensation signal includes at least one of a first compensation signal that decreases a luminance value of high luminance data of the second image data, a second compensation signal that increases a luminance value of low luminance data of the second image data, and a third compensation signal that maintains a luminance value of the second image data, and the outputting of the compensation signal further includes selecting at least one of the first, second, and third compensation signals according to whether the first afterimage component is recognized as the first, second, or third group afterimage component.

The compensation signal includes at least one of a first compensation signal that decreases a luminance value of high luminance data of the second image data, a second compensation signal that increases a luminance value of low luminance data of the second image data, and a third compensation signal that maintains a luminance value of the second image data, and the outputting of the compensation signal further includes selecting at least one of the first, second, and third compensation signals according to whether the second afterimage component is recognized as the first, second, or third group afterimage component.

According to the above, the controller separates the image data into the first image data and the second image data using the deep neural network. The controller controls the luminance of the afterimage component by controlling the luminance value of the second image data. The image is prevented from being damaged in the area adjacent to the afterimage component. Accordingly, the method of preventing afterimage caused by deterioration and the display device DD with improved display characteristics may be provided.

BRIEF DESCRIPTION OF THE DRAWINGS

The present disclosure will become readily apparent by reference to the following detailed description when considered in conjunction with the accompanying drawings wherein.

DETAILED DESCRIPTION

Figure 1:
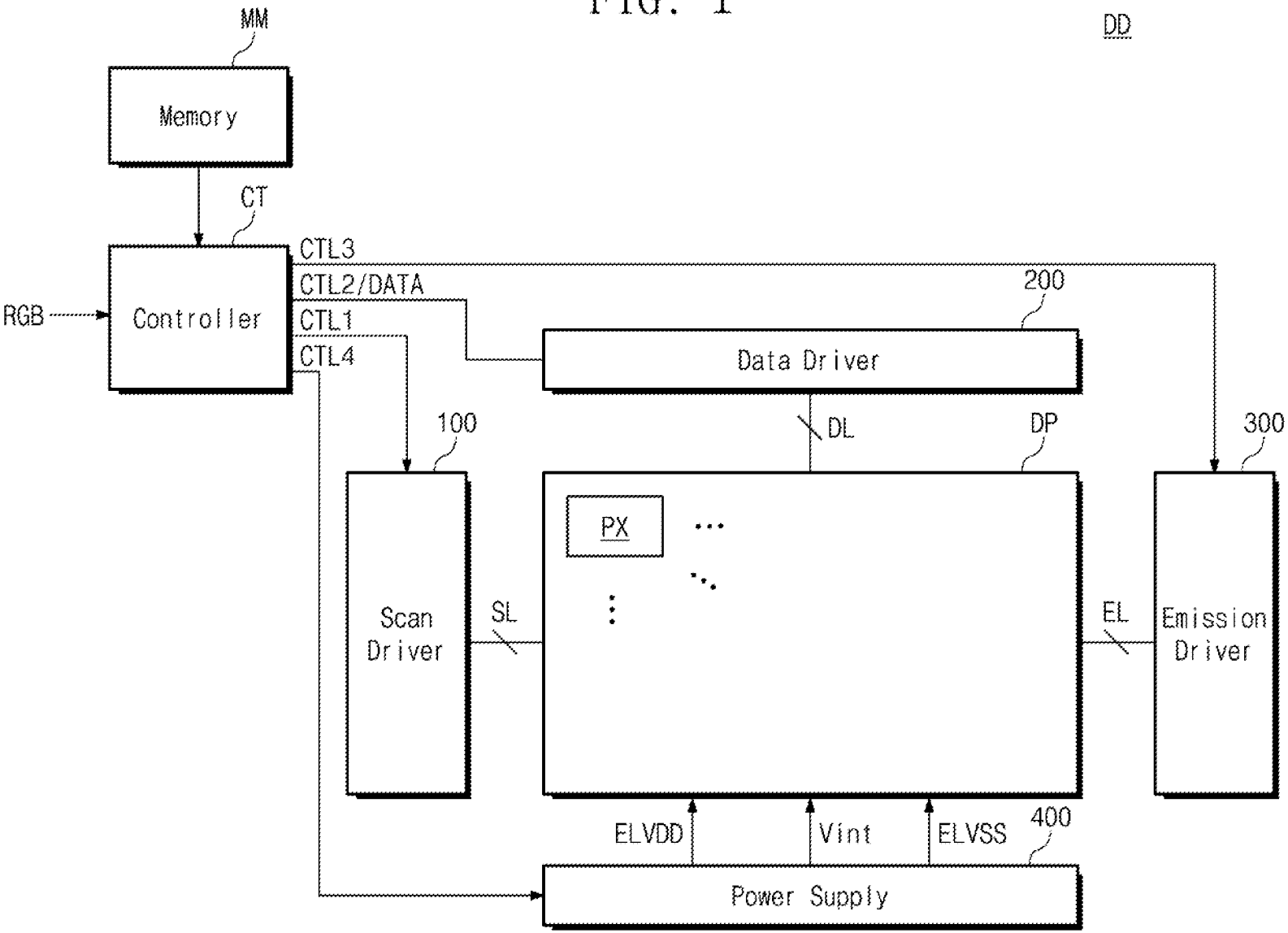
FIG. 1 is a block diagram showing a display device according to an exemplary embodiment of the present disclosure.

The present disclosure relates to systems and methods for preventing an afterimage in a display device. Specifically, embodiments of the present disclosure provide a display device that includes a controller and a display panel displaying an image corresponding to the first converted image data and the second converted image data. The controller includes a detector, a compensator, and a converter. The controller receives image data and converts the image data to output first converted image data and second converted image data. The detector separates image data into first image data corresponding to a first image recognized as a non-afterimage component and second image data corresponding to a second image recognized as an afterimage component using a pre-trained deep neural network. The compensator outputs a compensation signal to control a luminance value of the second image data. The converter converts the first image data to first converted image data and converting the second image data to second converted image data based on the compensation signal.

The controller separates image data into first image data and second image data using a deep neural network. The controller controls the luminance of the afterimage component by controlling the luminance value of the second image data, and the device is protected from damage in the area adjacent to the afterimage component. Accordingly, the present disclosure provides a method of preventing afterimage caused by deterioration of the display device, thereby improving display characteristics of the display device.

In the present disclosure, it will be understood that when an element or layer is referred to as being "on", "connected to" or "coupled to" another element or layer, the element or layer can be directly on, connected or coupled to the other element or layer or intervening elements or layers may be present. Like numerals refer to like elements throughout the disclosure. In the drawings, the thickness, ratio, and dimension of components may be exaggerated for an effective description of the technical content. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Therefore, a first element, component, region, layer or section discussed below could be termed a second element, component, region, layer or section without departing from the teachings of the present disclosure. As used herein, the singular forms, "a", "an" and "the" are intended to include the plural forms as well, unless the context clearly indicates otherwise.

Spatially relative terms, such as "beneath", "below", "lower", "above", "upper" and the like, may be used herein for ease of description to describe one element or feature's relationship to another element(s) or feature(s) as illustrated in the figures.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted with a meaning consistent with the term's meaning in the context of the relevant art and will not be interpreted in an idealized or overly formal sense unless expressly so defined herein.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Hereinafter, the present disclosure will be explained in detail with reference to the accompanying drawings.

Figure 2:
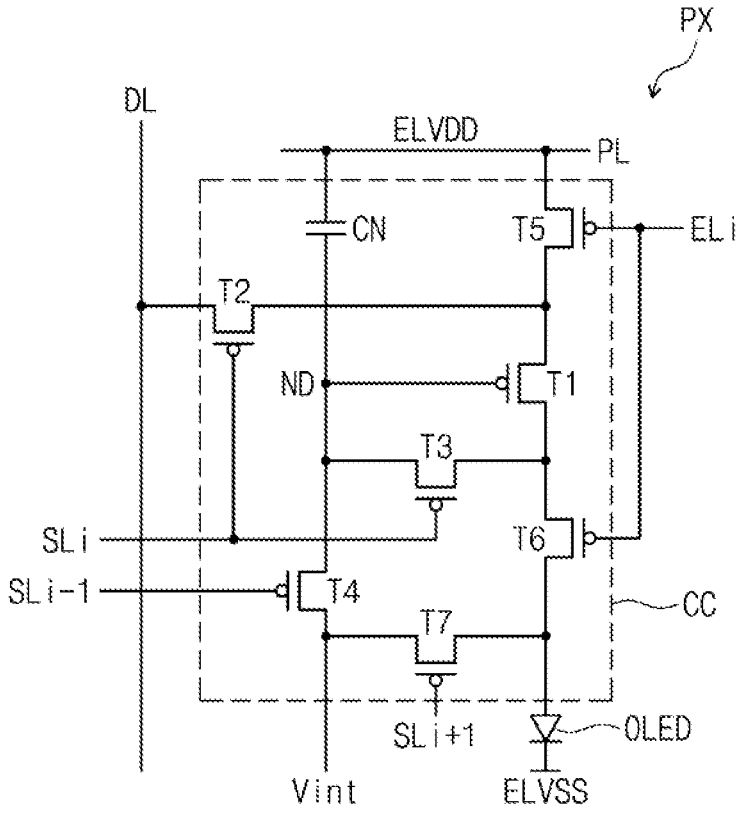
FIG. 2 is an equivalent circuit diagram showing one pixel among pixels according to an exemplary embodiment of the present disclosure.

FIG. 1 is a block diagram showing a display device DD according to an exemplary embodiment of the present disclosure, and FIG. 2 is an equivalent circuit diagram showing one pixel PX among pixels according to an exemplary embodiment of the present disclosure.

Referring to FIGS. 1 and 2, the display device DD may include a display panel DP, a controller CT, a scan driver 100, a data driver 200, an emission driver 300, a power supply 400, and a memory MM.

The display panel DP according to the exemplary embodiment of the present disclosure may be a light-emitting type display panel. However, the display panel DP should not be particularly limited. For instance, the display panel DP may be an organic light-emitting display panel or a quantum dot light-emitting display panel. For example, a light-emitting layer of the organic light-emitting display panel may include an organic light-emitting material. A light-emitting layer of the quantum dot light-emitting display panel may include at least one of a quantum dot and a quantum rod. Hereinafter, the organic light-emitting display panel will be described as the display panel DP.

The display panel DP may include a plurality of data lines DL, a plurality of scan lines SL, a plurality of emission control lines EL, and a plurality of pixels PX.

The data lines DL may cross the scan lines SL. The scan lines SL may be arranged substantially parallel to the emission control lines EL. The data lines DL, the scan lines SL, and the emission control lines EL may define a plurality of pixel areas. The pixels PX displaying an image may be arranged in the pixel areas. The data lines DL, the scan lines SL, and the emission control lines EL may be insulated from each other.

Each of the pixels PX may be connected to at least one data line, at least one scan line, and at least one emission control line. The pixel PX may include a plurality of sub-pixels. Each of the sub-pixels may display one of primary colors or one of mixed colors. The primary colors may include red, green, or blue. The mixed colors may include white, yellow, cyan, or magenta. However, this is merely exemplary, and the colors displayed by the sub-pixels according to the exemplary embodiment of the present disclosure should not be limited thereto or thereby.

The controller CT, the scan driver 100, the data driver 200, and the emission driver 300 may be electrically connected to the display panel DP in a chip-on-flexible (COF) printed circuit manner, a chip-on-glass (COG) manner, or a flexible printed circuit (FPC) manner.

The controller CT may receive image data RGB from the outside. The controller CT may output first, second, third, and fourth driving control signals CTL1, CTL2, CTL3, and CTL4 and converted image data DATA. The first driving control signal CTL1 may be a signal to control the scan driver 100. The second driving control signal CTL2 may be a signal to control the data driver 200. The third driving control signal CTL3 may be a signal to control the emission driver 300. The fourth driving control signal CTL4 may be a signal to control the power supply 400. The controller CT may output the converted image data DATA obtained by converting the image data RGB.

The scan driver 100 may provide scan signals to the pixels PX through the scan lines SL in response to the first driving control signal CTL1. The image may be displayed through the display panel DP based on the scan signals.

The data driver 200 may provide data voltages to the pixels PX through the data lines DL in response to the second driving control signal CTL2. The data driver 200 may convert the converted image data DATA to the data voltages. The images displayed through the display panel DP may be determined based on the data voltages.

The emission driver 300 may provide emission control signals to the pixels PX through the emission control lines EL in response to the third driving control signal CTL3. Luminance of the display panel DP may be controlled based on the emission control signals.

The power supply 400 may provide a first power voltage ELVDD, a second power voltage ELVSS, and an initialization voltage Vint to the display panel DP in response to the fourth driving control signal CTL4. The display panel DP may be driven by the first power voltage ELVDD and the second power voltage ELVSS.

Each of the pixels PX may include a light-emitting element OLED and a pixel circuit CC. The pixel circuit CC may include a plurality of transistors T1 to T7 and a capacitor CN. The pixel circuit CC may control an amount of current flowing through the light-emitting element OLED in response to the data voltage.

The light-emitting element OLED may emit a light at a predetermined luminance in response to the amount of current provided from the pixel circuit CC. The first power voltage ELVDD may have a level set higher than a level of the second power voltage ELVSS.

Each of the transistors T1 to T7 may include an input electrode (or a source electrode), an output electrode (or a drain electrode), and a control electrode (or a scan electrode). In the present disclosure, for the convenience of explanation, one electrode of the input electrode and the output electrode is referred to as a "first electrode", and the other electrode of the input electrode and the output electrode is referred to as a "second electrode".

A first electrode of a first transistor T1 may be connected to a power pattern VDD via a fifth transistor T5. A second electrode of the first transistor T1 may be connected to an anode electrode of the light-emitting element OLED via a sixth transistor T6. The first transistor T1 may be referred to as a "driving transistor".

A second transistor T2 may be connected between the data line DL and the first electrode of the first transistor T1. A control electrode of the second transistor T2 may be connected to an i-th scan line SLi. When an i-th scan signal is provided to the i-th scan line SLi, the second transistor T2 may be turned on. Therefore, the data line DL may be electrically connected to the first electrode of the first transistor T1.

A third transistor T3 may be connected between the second electrode of the first transistor T1 and a control electrode of the first transistor T1. A control electrode of the third transistor T3 may be connected to the i-th scan line SLi. When the i-th scan signal is provided to the i-th scan line SLi, the third transistor T3 may be turned on. Therefore, the second electrode of the first transistor T1 may be electrically connected to the control electrode of the first transistor T1. When the third transistor T3 is turned on, the first transistor T1 may be connected in a diode configuration.

A fourth transistor T4 may be connected between a node ND and an initialization voltage generator of the power supply 400. A control electrode of the fourth transistor T4 may be connected to an (i−1)th scan line SLi−1. When an (i−1)th scan signal is provided to the (i−1)th scan line SLi−1, the fourth transistor T4 may be turned on. Therefore, the initialization voltage Vint may be provided to the node ND.

The fifth transistor T5 may be connected between a power line PL and the first electrode of the first transistor T1. A control electrode of the fifth transistor T5 may be connected to an i-th emission control line ELi.

A sixth transistor T6 may be connected between the second electrode of the first transistor T1 and the anode electrode of the light-emitting element OLED. A control electrode of the sixth transistor T6 may be connected to the i-th emission control line ELi.

A seventh transistor T7 may be connected between the initialization voltage generator and the anode electrode of the light-emitting element OLED. A control electrode of the seventh transistor T7 may be connected to an (i+1)th scan line SLi+1. When an (i+1)th scan signal is provided to the (i+1)th scan line SLi+1, the seventh transistor T7 may be turned on. Therefore, the initialization voltage Vint may be provided to the anode electrode of the light-emitting element OLED.

The seventh transistor T7 may increase a black expression capability of the pixel PX. When the seventh transistor T7 is turned on, a parasitic capacitance (not shown) of the light-emitting element OLED may be discharged. When black luminance is implemented, the light-emitting element OLED does not emit light due to leakage current from the first transistor T1. Therefore, the black expression ability may be improved.

In FIG. 2, the control electrode of the seventh transistor T7 is connected to the (i+1)th scan line SLi+1. However, the present disclosure should not be limited thereto or thereby. For example, the control electrode of the seventh transistor T7 may be connected to the i-th scan line SLi or the (i−1)th scan line SLi−1.

In FIG. 2, the pixel circuit CC is implemented by PMOS transistors. However, the pixel circuit CC should not be limited thereto or thereby. For example, the pixel circuit CC may be implemented by NMOS transistors. According to another exemplary embodiment of the present disclosure, the pixel circuit CC may be implemented by a combination of NMOS transistors and PMOS transistors.

The capacitor CN may be disposed between the power line PL and the node ND. The capacitor CN may be charged with the data voltage. The amount of the current flowing through the first transistor T1 may be determined when the fifth transistor T5 and the sixth transistor T6 are turned on by the voltage charged in the capacitor CN. In the present disclosure, the equivalent circuit of the pixel PX should not be limited to the equivalent circuit shown in FIG. 2. According to another exemplary embodiment of the present disclosure, the pixel PX may be implemented in various ways that allow the light-emitting element OLED to emit the light.

The memory MM may store information about voltage values of signals sent and received between components CT, DP, 100, 200, 300, and 400 of the display device DD. The memory MM may be provided separately or may be included in at least one component of the components CT, DP, 100, 200, 300, and 400.

Figure 3:
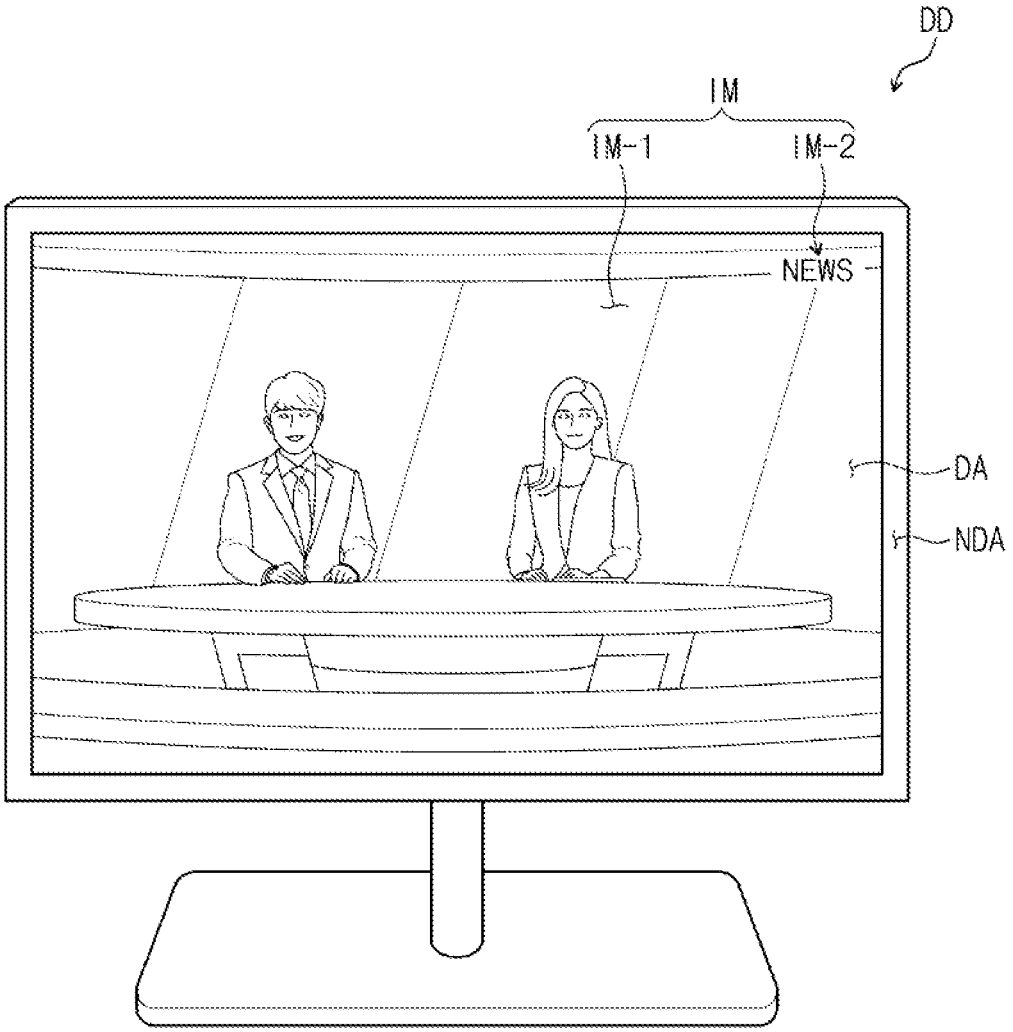
FIG. 3 is a front view showing a display device through which an image including an afterimage component is displayed according to an exemplary embodiment of the present disclosure.

FIG. 3 is a front view showing a display device through which an image including an afterimage component is displayed according to an exemplary embodiment of the present disclosure.

Referring to FIG. 3, the display device DD may include a display area DA and a non-display area NDA. The display area DA may provide an image IM to be displayed. The non-display area NDA may be disposed around the display area DA. The pixels PX (refer to FIG. 1) may be arranged in the display area DA. The image IM may include a first image IM-1 and a second image IM-2. The first image IM-1 may be recognized as a non-afterimage component. The second image IM-2 may be recognized as the afterimage component. The afterimage component may be an object which has a higher probability of an afterimage occurrence due to deterioration of the light-emitting element OLED (refer to FIG. 2) included in the display device DD than a probability of the afterimage occurrence of the non-afterimage component.

FIG. 3 shows a news screen as an example of the image IM. In the news screen, a certain word or image, such as a logo of a broadcasting company, may be continuously displayed as the second image IM-2 in the upper left or upper right portion, but the disclosure is not limited thereto or thereby. The displayed word or image may be present anywhere on the screen. FIG. 3 shows the word "NEWS" displayed on the upper right portion as a representative example.

Figure 4:
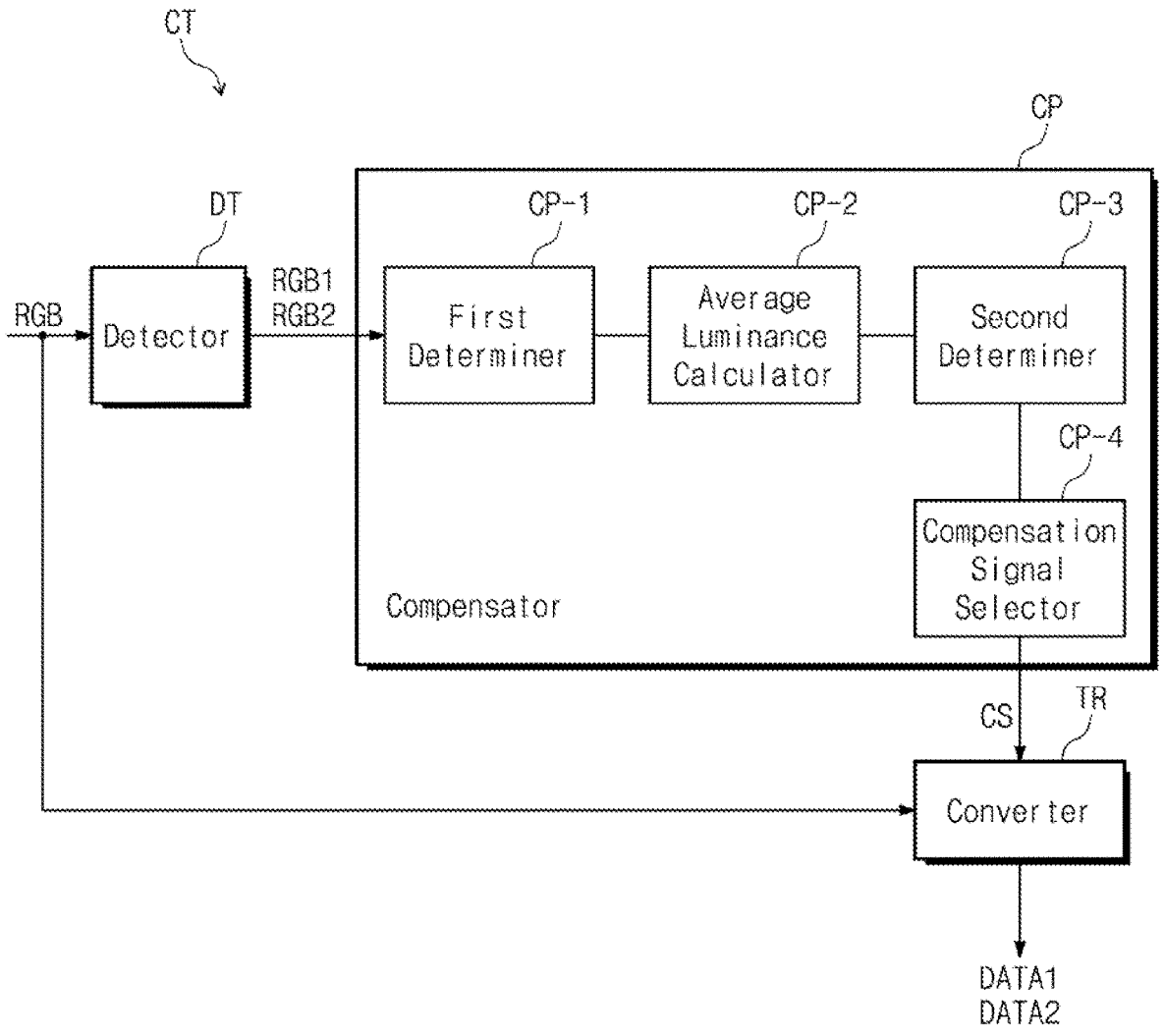
FIG. 4 is a block diagram showing a controller according to an exemplary embodiment of the present disclosure.
Figure 5:
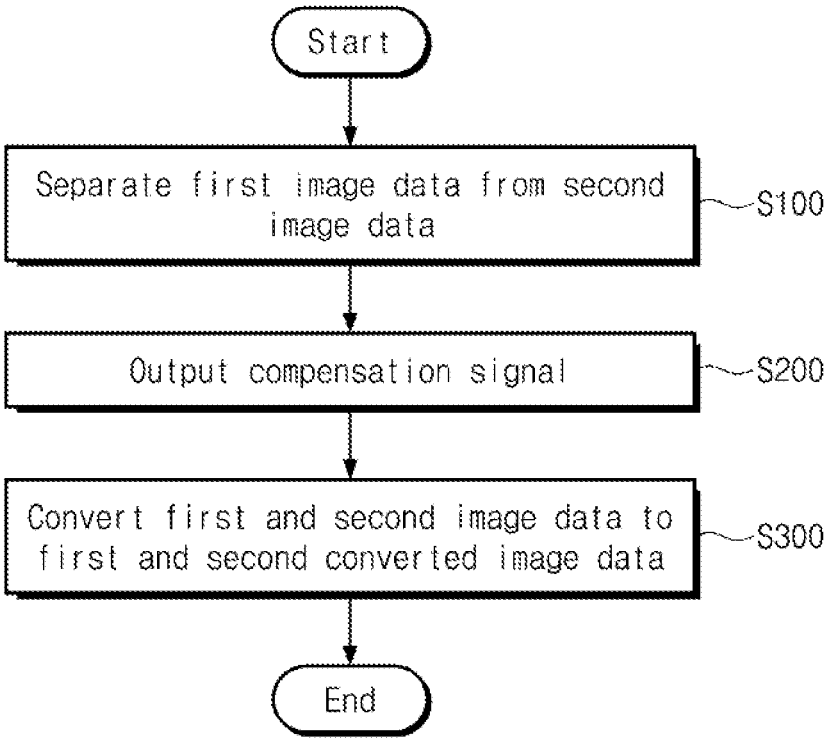
FIG. 5 is a flowchart showing a method of preventing an afterimage according to an exemplary embodiment of the present disclosure.

FIG. 4 is a block diagram showing the controller CT according to an exemplary embodiment of the present disclosure, and FIG. 5 is a flowchart showing a method of preventing the afterimage according to an exemplary embodiment of the present disclosure.

Referring to FIGS. 3 to 5, the controller CT may receive the image data RGB, may convert the image data RGB to the converted image data DATA (refer to FIG. 1), and may output the converted image data DATA. The converted image data DATA (refer to FIG. 1) may include first converted image data DATA1 and second converted image data DATA2.

The controller CT may include a detector DT, a compensator CP, and a converter TR.

The detector DT may separate the image data RGB into first image data RGB1 corresponding to the first image IM-1 and second image data RGB2 corresponding to the second image IM-2 using a pre-trained deep neural network (S100).

The memory MM (refer to FIG. 1) may receive data used to update the deep neural network from the outside. The detector DT may receive the updated deep neural network from the memory MM (refer to FIG. 1).

The compensator CP may output a compensation signal CS to control a luminance value of the second image data RGB2 (S200).

The converter TR may receive the image data RGB and the compensation signal CS. The converter TR may convert the first image data RGB1 to the first converted image data DATA1 based on the image data RGB and may convert the second image data RGB2 to the second converted image data DATA2 based on the image data RGB and the compensation signal CS (S300). The display panel DP (refer to FIG. 1) may display the image IM (refer to FIG. 3) corresponding to the first converted image data DATA1 and the second converted image data DATA2.

According to embodiments of the present disclosure, the detector DT may separate the image data RGB into the first image data RGB1 and the second image data RGB2 using the deep neural network (S100). The compensation signal CS may control a luminance of the afterimage component of the second image IM-2 corresponding to the second image data RGB2. The image IM may be prevented from being damaged in an area adjacent to the afterimage component. Accordingly, the method of preventing afterimage caused by deterioration and the display device DD (refer to FIG. 1) with improved display characteristics may be provided.

Figure 6:
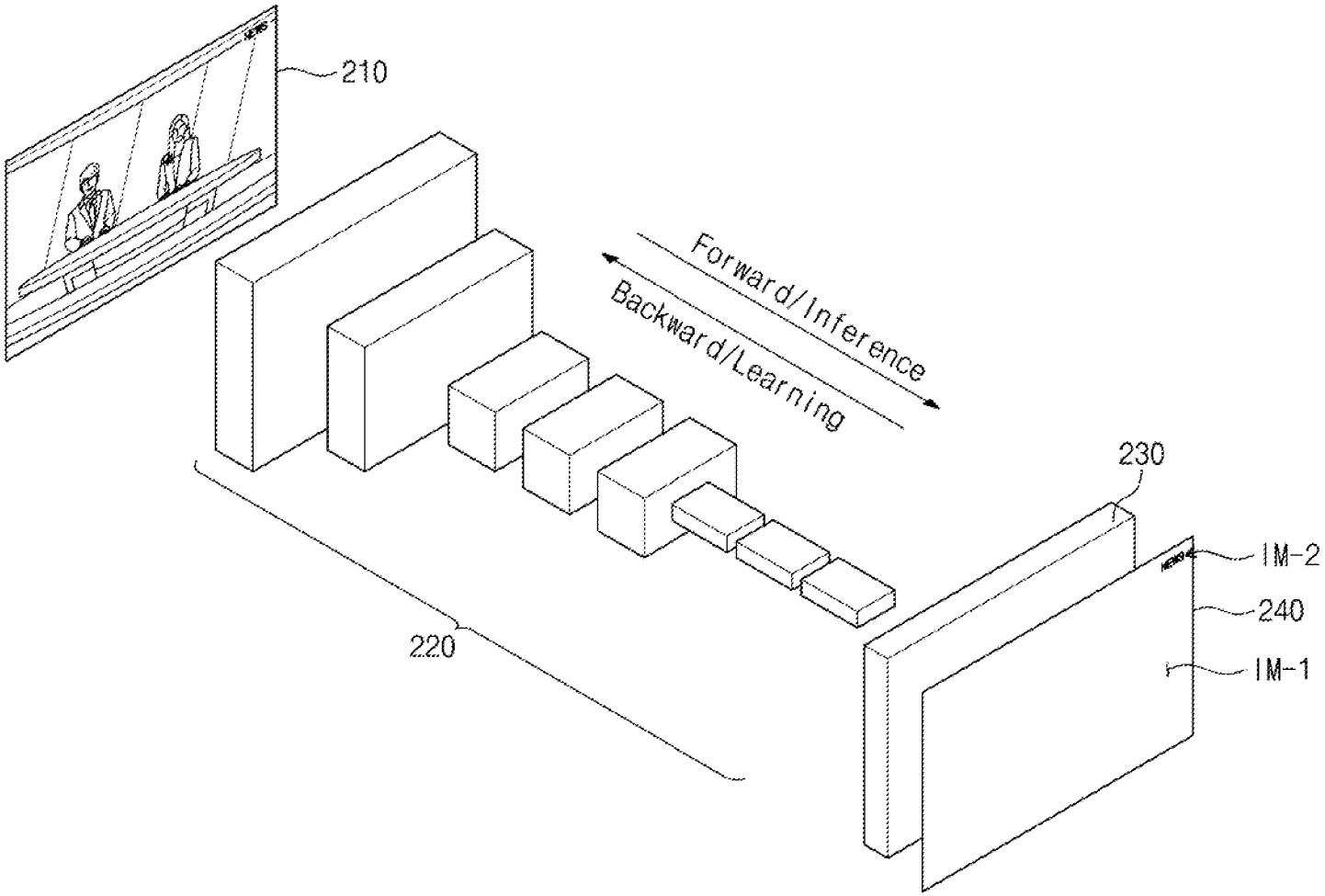
FIG. 6 is a view showing a fully convolutional neural network according to an exemplary embodiment of the present disclosure.

FIG. 6 is a view showing a fully convolutional neural network according to an exemplary embodiment of the present disclosure.

Referring to FIGS. 4 and 6, artificial intelligence refers to the field of science concerned with the study and design of intelligent machines, and machine learning refers to the field of science defining and solving various problems dealt with in the field of artificial intelligence. Machine learning may refer to algorithms that computer systems use to enhance the performance of a specific task, based on consistent experience on the task (e.g., using training data).

A deep neural network is one example of a model used in machine learning. In some examples, a deep neural network may be designed to simulate a human brain structure on the detector DT. Deep neural networks may include artificial neurons (i.e., nodes) that form a network connected by synaptic connections. In some cases, the term deep neural network refers to a model with problem-solving ability in general. A deep neural network may be defined by a connection pattern between neurons of different layers, a learning process that updates model parameters, and an activation function that generates an output value.

A deep neural network may include an input layer, an output layer, and at least one hidden layer. Each layer may include one or more neurons, and the deep neural network may include synapses (i.e., connections) that link neurons to neurons. In a deep neural network, each neuron may output function values of activation functions for signals, weights, and deflections, which are input through the synapses.

In some cases, a deep neural network may be trained according to a supervised learning algorithm. For example, a supervised learning algorithm may be used to find a fixed answer through an algorithm. Accordingly, a deep neural network based on a supervised learning algorithm may infer the function from training data. In a supervised learning algorithm, a labeled sample may be used for the training. The labeled sample may refer to a particular output value that should be inferred by the deep neural network when learning data are input to the deep neural network.

The algorithm may receive a series of learning data and may predict a particular output value corresponding to the learning data. During training, prediction errors may be identified by comparing an actual output value and the particular output value with respect to input data, and the algorithm or network parameters may be modified based on the result.

The output value of a supervised learning algorithm may include semantic segmentation. Semantic segmentation may refer to the technique of classifying each pixel in an image into an object class. Semantic segmentation may refer to the technique of distinguishing objects constituting an input image 210 in pixel units within the input image 210 corresponding to the image data RGB input to the algorithm. For example, objects included in each of the first image IM-1 recognized as the non-afterimage component and the second image IM-2 recognized as the afterimage component may be distinguished from each other in pixel units in labeled data 240. As an example, the second image IM-2 may correspond to the word "NEWS" displayed in a certain portion of the image IM (refer to FIG. 3).

The deep neural network may perform the semantic segmentation on the image data RGB in the unit of frame to separate the image data RGB into the first image data RGB1 corresponding to the first image IM-1 and the second image data RGB2 corresponding to the second image IM-2. The deep neural network may include a fully convolutional neural network (FCN), a convolutional neural network (CNN), a recurrent neural network (RNN), a deep belief network (DMN), or a restricted Boltzman machine (RBM). However, this is merely exemplary, and the deep neural network should not be limited thereto or thereby. Hereinafter, an exemplary deep neural network will be described as including a fully convolutional neural network.

FIG. 6 shows the input image 210, the fully convolutional neural network 220, an activation map 230 output from the fully convolutional neural network 220, and the labeled data 240.

Convolutional layers of the fully convolutional neural network 220 may be used to extract features, such as borders, lines, colors, etc., from the input image 210. from the input image 210. Each convolutional layer may receive data, may process the data input applied thereto, and may generate data output therefrom. The data output from the convolutional layer may be generated by combining the input data with one or more filters.

Initial convolutional layers of the fully convolutional neural network 220 may be operated to extract simple features with low levels from the input. Next convolutional layers may be operated to extract complex features with higher levels than those of the initial convolutional layers. The data output from each convolutional layer may be referred to as an activation map or a feature map. The fully convolutional neural network 220 may perform other processing operations in addition to applying a convolution filter to the activation map. The processing operation may include a pooling operation. However, this is merely exemplary, and the processing operation according to the exemplary embodiment of the present disclosure should not be limited thereto or thereby. For example, the processing operation may include a resampling operation.

When the input image 210 passes through several layers of the fully convolutional neural network 220, a size of the activation map may be reduced. A process of scaling up the result of the reduced activation map by the size of the input image 210 is used to perform the estimation in pixel units since the semantic segmentation involves the estimation of the object in pixel units. As a method of enlarging the value obtained through a 1×1 convolution operation to the size of the input image 210, a bilinear interpolation technique, a deconvolution technique, or a skip-layer technique may be used. The size of the activation map 230 finally output from the fully convolutional neural network 220 may be substantially the same as the input image 210. Accordingly, the activation map 230 may maintain information about position of the object. The process in which the fully convolutional neural network 220 receives the input image 210 and outputs the activation map 230 may be called "forward inference".

The activation map 230 output from the fully convolutional neural network 220 may be compared with the labeled data 240 of the input image 210. Therefore, losses may be calculated. The losses may be propagated back to the convolutional layers through a back-propagation technique. Connection weights in the convolutional layers may be updated based on the losses propagated back. As a method of calculating the losses, a hinge loss, a square loss, a softmax loss, a cross-entropy loss, an absolute loss, and an insensitive loss may be used depending on the purpose.

The method of learning through the back-propagation algorithm may be a method of updating the weights of the nodes constituting the learning network according to the loss calculated by transferring a value from the output layer to the input layer in the case where the output value obtained through a process starting from input layer and ending at the output layer is a wrong answer when compared with a reference label value. In this case, a training data set provided to the fully convolutional neural network 220 may be defined as ground truth data or the labeled data 240. As the training data set according to the exemplary embodiment of the present disclosure, thousands to tens of thousands of still images may be provided. The label may indicate a class of the object. The object may correspond to the afterimage component of the second image IM-2. For example, the label may include a logo, a banner, a caption, a clock, a weather icon, or the like.

After the fully convolutional neural network 220 performs the learning process using the input image 210, a learning model with optimized parameters may be generated. The labeled data corresponding to the input data may be predicted when unlabeled data is input to the learning model.

According to the present disclosure, the deep neural network of the detector DT may include the fully convolutional neural network 220. The fully convolutional neural network 220 does not require a frame buffer and may segment the object corresponding to the afterimage component according to frames of the image data RGB, thereby classifying the afterimage component itself in real-time. The compensator CP may control the luminance of the second image data RGB2 corresponding to the second image IM-2, which is recognized as the afterimage. Therefore, the compensator CP may prevent the afterimage of the image IM from being generated. Accordingly, the method of preventing afterimage caused by deterioration and the display device DD (refer to FIG. 1) with improved display characteristics may be provided.

Figure 7:
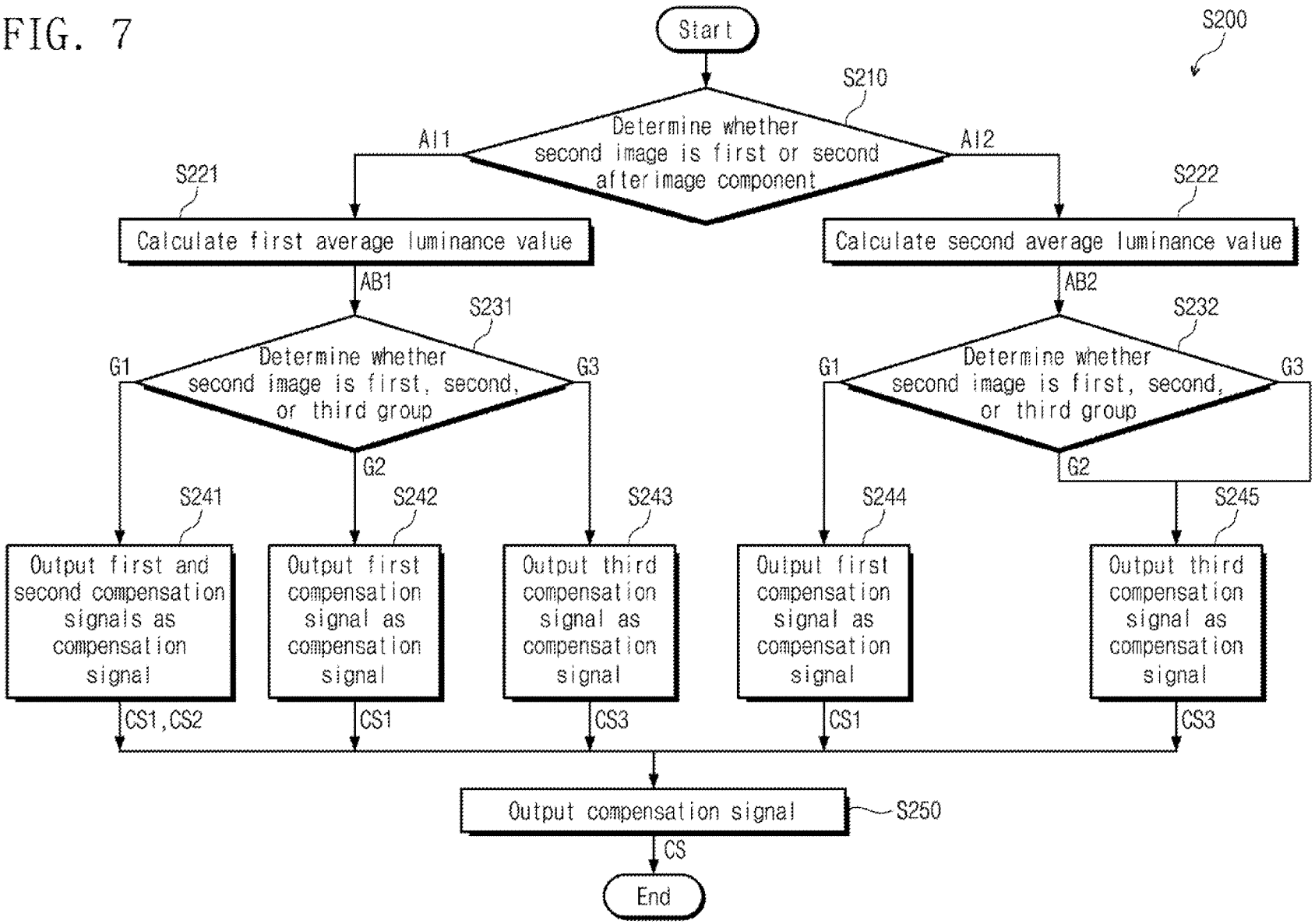
FIG. 7 is a flowchart showing outputting a compensation signal according to an exemplary embodiment of the present disclosure.

FIG. 7 is a flowchart showing outputting a compensation signal according to an exemplary embodiment of the present disclosure.

Referring to FIGS. 4, 6, and 7, the compensator CP may include a first determiner CP-1, an average luminance calculator CP-2, a second determiner CP-3, and a compensation signal selector CP-4.

The afterimage component of the second image IM-2 corresponding to the second image data RGB2 provided from the detector DT may be classified into a first afterimage component AI1 and a second afterimage component AI2. The second afterimage component AI2 may have a transmittance higher than the first afterimage component AI1.

The first determiner CP-1 may determine whether the second image IM-2 is recognized as the first afterimage component AI1 or the second afterimage component AI2 (S210).

The average luminance calculator CP-2 may calculate a first average luminance value AB1 using a spatial average luminance value of the second image data RGB2 (S221) when the second image IM-2 is recognized as the first afterimage component AI1 by the first determiner CP-1.

The average luminance calculator CP-2 may calculate a second average luminance value AB2 using the spatial average luminance value and a temporal average luminance value of the second image data RGB2 (S222) when the second image IM-2 is recognized as the second afterimage component AI2 by the first determiner CP-1.

The spatial average luminance value may include at least one of an average luminance value of an area obtained by enlarging an edge of the second image IM-2 by predetermined pixels, an average luminance value of a rectangular area including the second image IM-2, and an average luminance value of an area of plural pixels arranged in a horizontal direction and including the second image IM-2.

The temporal average luminance value may be an average luminance value for a predetermined time of the second image IM-2.

Each of the first afterimage component AI1 and the second afterimage component AI2 may be classified into a first group G1, a second group G2, and a third group G3. The first group G1 may be defined as a display cumulative time ratio of the second image IM-2 to a display time of the image data RGB is equal to or greater than about 50% and equal to or smaller than about 100%. The second group G2 may be defined as the display cumulative time ratio exceeds about 20% and is smaller than about 50%. The third group G3 may be defined as the display cumulative time ratio is equal to or greater than about 10% and is equal to or smaller than about 20%. The display cumulative time ratio may refer to the ratio of display time for the second image IM-2 to a display time of the image data RGB.

The second determiner CP-3 may determine whether the second image IM-2 is recognized as an afterimage component of the first group G1, the second group G2, or the third group G3 (S231 and S232).

The compensation signal CS may include at least one of a first compensation signal CS1 that decreases a luminance value of high luminance data of the second image data RGB2, a second compensation signal CS2 that increases a luminance value of low luminance data of the second image data RGB2, and a third compensation signal CS3 that maintains a luminance value of the second image data RGB2.

When the second image IM-2 is recognized as the first afterimage component AI1, the first compensation signal CS1 may decrease the luminance value of the second image IM-2. The decreased luminance value may have the luminance value of the second image IM-2 higher than the first average luminance value AB1. Additionally or alternatively, the second compensation signal CS2 may increase the luminance value of the second image IM-2 to have the luminance value of the second image IM-2 lower than the first average luminance value AB1.

When the second image IM-2 is recognized as the second afterimage component AI2, the first compensation signal CS1 may decrease the luminance value of the second image IM-2 to have the luminance value of the second image IM-2 higher than the second average luminance value AB2.

The compensation signal selector CP-4 may output at least one of the first compensation signal CS1, the second compensation signal CS2, and the third compensation signal CS3 as the compensation signal CS according to the classification of the second image IM-2 classified by the first determiner CP-1 and the second determiner CP-2.

When the first determiner CP-1 recognizes the second image IM-2 as the first afterimage component AI1 and the second determiner CP-3 recognizes the second image IM-2 as the first group G1, the compensation signal selector CP-4 may output the first compensation signal CS1 and the second compensation signal CS2 as the compensation signal CS (S241 and S250). For example, the second image IM-2 may include a broadcasting company's logo, a clock, a TV program's logo, and the like.

The compensation signal selector CP-4 may output the first compensation signal CS1 as the compensation signal CS (S242 and S250) when the first determiner CP-1 recognizes the second image IM-2 as the first afterimage component AI1 and the second determiner CP-3 recognizes the second image IM-2 as the second group G2. For example, the second image IM-2 may include a banner disposed on the image, a small screen on the screen, a caption, a weather icon, and the like.

When the first determiner CP-1 recognizes the second image IM-2 as the first afterimage component AI1 and the second determiner CP-3 recognizes the second image IM-2 as the third group G3, the compensation signal selector CP-4 may output the third compensation signal CS3 as the compensation signal CS (S243 and S250).

When the first determiner CP-1 recognizes the second image IM-2 as the second afterimage component AI2 and the second determiner CP-3 recognizes the second image IM-2 as the first group G1, the compensation signal selector CP-4 may output the first compensation signal CS1 as the compensation signal CS (S244 and S250). For example, the second image IM-2 may include a transparent broadcasting company's logo.

When the first determiner CP-1 recognizes the second image IM-2 as the second afterimage component AI2 and the second determiner CP-3 recognizes the second image IM-2 as the second group G2 or the third group G3, the compensation signal selector CP-4 may output the third compensation signal CS3 as the compensation signal CS (S245 and S250). For example, the second image IM-2 may include a transparent banner.

According to the present disclosure, each of the first determiner CP-1 and the second determiner CP-3 may classify the second image IM-2. The first determiner CP-1 may classify the afterimage component of the second image IM-2, according to whether the afterimage component has transparency. The second determiner CP-3 may classify the second image IM-2 according to a time how long the afterimage component of the second image IM-2 is displayed. The compensation signal selector CP-4 may select each compensation signal CS based on content classified by each of the first determiner CP-1 and the second determiner CP-3. An afterimage prevention method may be selected according to the type of the afterimage component through the controller CT. Accordingly, the method of preventing afterimage caused by deterioration and the display device DD (refer to FIG. 1) with increased display characteristics may be provided.

Thus, embodiments of the inventive concept include a method of preventing an afterimage. The method may include separating image data into a non-afterimage component and an afterimage component using an artificial neural network; classifying the afterimage component based a transmittance value, a luminance value, or both; and applying compensation to the image data based on the classification.

In some examples, classifying the afterimage component includes categorizing the afterimage component based on the transmittance value; and calculating the luminance value based on the categorization, wherein the afterimage component is classified based on the luminance value. In some cases, the luminance value is based on a spatial average luminance value when the transmittance value is below a threshold value, and is based on the spatial average luminance value and a temporal average luminance value when the transmittance value is above the threshold value.

Although the exemplary embodiments of the present disclosure have been described, it is understood that the present disclosure should not be limited to these exemplary embodiments but various changes and modifications can be made by one ordinary skilled in the art within the spirit and scope of the present disclosure as hereinafter claimed. Therefore, the disclosed subject matter should not be limited to any single embodiment described herein, and the scope of the present inventive concept shall be determined according to the attached claims.

What is claimed is:

1. A display device comprising:

a controller configured to receive an image data and to convert the image data to output a first converted image data and a second converted image data; and a display panel configured to display an image corresponding to the first converted image data and the second converted image data, the controller comprising:

a detector configured to separate the image data into first image data corresponding to a first image recognized as a non-afterimage component and second image data corresponding to a second image recognized as an afterimage component using a pre-trained deep neural network;

a compensator configured to output a compensation signal to control a luminance value of the second image data;

a converter configured to convert the first image data to the first converted image data and to convert the second image data to the second converted image data based on the compensation signal;

wherein the compensation signal comprises at least one of a first compensation signal that decreases a luminance value of high luminance data of the second image data, a second compensation signal that increases a luminance value of low luminance data of the second image data, and a third compensation signal that maintains a luminance value of the second image data; and wherein the afterimage component is classified into a first afterimage component and a second afterimage component having a transmittance higher than a transmittance of the first afterimage component, and the compensator comprises a first determiner that determines whether the second image is recognized as the first afterimage component or the second afterimage component.

2. The display device of claim 1, wherein the deep neural network performs a semantic segmentation on the image data to separate the image data into the first image data and the second image data.

3. The display device of claim 2, wherein the deep neural network comprises a fully convolutional neural network.

4. The display device of claim 1, further comprising a memory in which the deep neural network is stored, wherein the memory is configured to receive data to update the deep neural network.

5. The display device of claim 1, further comprising an average luminance calculator configured to calculate a first average luminance value using a spatial average luminance value of the second image data when the second image is recognized as the first afterimage component and to calculate a second average luminance value using the spatial average luminance value and a temporal average luminance value of the second image data when the second image is recognized as the second afterimage component.

6. The display device of claim 5, wherein, when the second image is recognized as the first afterimage component, the first compensation signal decreases the luminance value of the second image to have a luminance value of the second image higher than the first average luminance value and the second compensation signal increases the luminance value of the second image to have a luminance value of the second image lower than the first average luminance value, and when the second image is recognized as the second afterimage component, the first compensation signal decreases the luminance value of the second image to have a luminance value of the second image higher than the second average luminance value.

7. The display device of claim 6, wherein each of the first afterimage component and the second afterimage component is classified into a first group in which a display cumulative time ratio of the second image to a display time of the image data is equal to or greater than about 50% and equal to or smaller than about 100%, a second group in which the display cumulative time ratio exceeds about 20% and is smaller than about 50%, and a third group in which the display cumulative time ratio is equal to or greater than about 10% and is equal to or smaller than about 20%, and the compensator further comprises a second determiner that determines whether the second image is recognized as the first, second, or third group afterimage component.

8. The display device of claim 7, wherein the compensation signal comprises the first compensation signal and the second compensation signal when the first afterimage component is the first group.

9. The display device of claim 7, wherein the compensation signal comprises the first compensation signal when the first afterimage component is the second group.

10. The display device of claim 7, wherein the compensation signal comprises the third compensation signal when the first afterimage component is the third group.

11. The display device of claim 7, wherein the compensation signal comprises the first compensation signal when the second afterimage component is the first group.

12. The display device of claim 7, wherein the compensation signal comprises the third compensation signal when the second afterimage component is the second group or the third group.

13. A method of preventing an afterimage, comprising:

separating image data into first image data corresponding to a first image recognized as a non-afterimage component and second image data corresponding to a second image recognized as an afterimage component using a pre-trained deep neural network;

outputting a compensation signal to control a luminance value of the second image data; and converting the first image data to a first converted image data and converting the second image data to a second converted image data based on the compensation signal;

wherein the separating of the first image data from the second image data comprises performing a semantic segmentation on the image data; and wherein the afterimage component is classified into a first afterimage component and a second afterimage component having a transmittance higher than a transmittance of the first afterimage component, and the outputting of the compensation signal comprises determining whether the second image is recognized as the first afterimage component or the second afterimage component.

14. The method of claim 13, wherein each of the first afterimage component and the second afterimage component is classified into a first group in which a display cumulative time ratio of the second image to a display time of the image data is equal to or greater than about 50% and equal to or smaller than about 100%, a second group in which the display cumulative time ratio exceeds about 20% and is smaller than about 50%, and a third group in which the display cumulative time ratio is equal to or greater than about 10% and is equal to or smaller than about 20%, and the outputting of the compensation signal further comprises determining whether the second image is recognized as the first, second, or third group.

15. The method of claim 14, wherein the compensation signal comprises at least one of a first compensation signal that decreases a luminance value of high luminance data of the second image data, a second compensation signal that increases a luminance value of low luminance data of the second image data, and a third compensation signal that maintains a luminance value of the second image data, and the outputting of the compensation signal further comprises selecting at least one of the first, second, and third compensation signals according to whether the first afterimage component is recognized as the first, second, or third group afterimage component.

16. The method of claim 14, wherein the compensation signal comprises at least one of a first compensation signal that decreases a luminance value of high luminance data of the second image data, a second compensation signal that increases a luminance value of low luminance data of the second image data, and a third compensation signal that maintains a luminance value of the second image data, and the outputting of the compensation signal further comprises selecting at least one of the first, second, and third compensation signals according to whether the second afterimage component is recognized as the first, second, or third group afterimage component.

* * * * *